US005623948A

United States Patent [19]

Van Morris

[11] Patent Number: 5,623,948

[45] Date of Patent: Apr. 29, 1997

[54] SAFETY AMBULATORY SUPPORT APPARATUS FOR PATIENTS

[76] Inventor: C. Van Morris, 297 Boulevard, Athens, Ga. 30601

[21] Appl. No.: 429,824

[22] Filed: Apr. 27, 1995

Related U.S. Application Data

[63] Continuation-in-part of Ser. No. 99,916, Jul. 30, 1993, Pat. No. 5,456,655.

[51] Int. Cl.[6] ..... A61G 15/00; A61G 7/08; A61G 7/10

[52] U.S. Cl. ..... 128/845; 5/83.1; 5/81.1 R

[58] Field of Search ..... 212/210, 205, 212/206; 5/81.1, 83.1, 84.1, 85.1, 86.1, 87.1, 88.1, 89.1; 601/23; 128/846; 272/70.3

[56] References Cited

U.S. PATENT DOCUMENTS

| | | | |
|---|---|---|---|
| 669,217 | 3/1901 | Hanson | 5/83.1 |
| 1,385,424 | 7/1921 | Billings . | |
| 3,606,045 | 9/1971 | Abromavage et al. . | |
| 4,003,479 | 1/1977 | Reyer . | |
| 4,125,908 | 11/1978 | Vail et al. . | |
| 4,199,829 | 4/1980 | Watanabe | 5/81.1 |
| 4,202,063 | 5/1980 | Murray | 5/81.1 |
| 4,243,147 | 1/1981 | Twitchell et al. . | |
| 4,256,098 | 3/1981 | Swan | 5/81.1 |
| 4,445,502 | 5/1984 | Swan et al. . | |
| 4,739,526 | 4/1988 | Hollick | 5/83.1 |
| 4,742,588 | 5/1988 | James | 5/83.1 |
| 4,795,122 | 1/1989 | Petre . | |
| 4,973,044 | 11/1990 | Jones | 272/70.3 |
| 5,072,840 | 12/1991 | Asakawa et al. . | |
| 5,273,502 | 12/1993 | Kelsey et al. . | |

FOREIGN PATENT DOCUMENTS

0304538A2 1/1989 European Pat. Off. .

*Primary Examiner*—Robert A. Hafer
*Assistant Examiner*—Benjamin K. Koo
*Attorney, Agent, or Firm*—Jones & Askew

[57] ABSTRACT

A safety ambulatory support system for providing support for a patient. The support system includes a support garment attached by a tether line to a support carrier carried by an overhead system. The overhead system allows the support carrier to travel within the confines of the overhead system so that the support carrier may be located above a patient at any time. The support garment is configured so that the tether line extends from the patient adjacent the vertex of the patient's head thereby preventing the tether line from contacting the patient about the neck and shoulders when a support force is applied to the tether. The support system supplies a passive fall interruption device which restrain freefalling of the patient. The restraint system allows the patient, once falling, to be lowered slowly to the ground. In addition, the overhead support system of the present invention provides an accessory mount in which folding tables, IVs, monitors, and the like may be suspended from the ceiling and may be moved anywhere in the region underneath the overhead system.

5 Claims, 11 Drawing Sheets

SAFETY AMBULATORY SUPPORT APPARATUS FOR PATIENTS

CROSS-REFERENCE TO RELATED APPLICATION

This is a continuation-in-part application of U.S. patent application Ser. No. 08/099,916, filed Jul. 30, 1993, by C. Van Morris, entitled AMBULATORY SUPPORT SYSTEM FOR PATIENTS, now U.S. Pat. No. 5,456,655.

FIELD OF THE INVENTION

The present invention is directed to a system of ambulatory support for a patient, and more specifically is directed to a safety support system comprising a tether for supporting a patient for ambulation.

BACKGROUND OF THE INVENTION

Several factors suggest a growing demand for health care in the foreseeable future, the greatest of which is the aging of the population. The population of the United States has aged dramatically since the beginning of this century. In 1900, only 4% of the population was 65 years or older. This number had increased to 13% of the population (or 30 million people) by 1986 and is projected to grow to 21% in 2020 and 30% in 2050 (*Aging America,* 1987–88).

The healthcare system will have to respond to the aging of the population. As people age they make greater use of health services than do younger persons. According to the National Health Interview Study, in 1987 the rate of discharges from short-stay hospitals was 69.2 per 1,000 population for persons 15–44 years of age, 143.3 for those 45–64, and 255.8 per 1,000 for those 65 years of age and older. If current usage rates by the elderly were to continue, the increased number of elderly persons will result in twice as many physician visits and hospital stays in the year 2020 than at present and almost three times as many elderly residents in nursing homes than the current 1.3 million (*DHHS,* 1987).

The elderly have health care needs ranging from preventative services to long-term care. Of special interest is the fact that advancing age brings about a decline in mobility, with significant limitations evident in the eighties and nineties. In addition to physical limitations, a significant proportion of the elderly have mental health problems, such as Alzheimer's disease and multi-infarct dementia.

Another factor that will increase demand for medical care is the AIDS epidemic. Until an effective treatment for the underlying pathological processes of this disorder is found, the symptomatic treatment of sufferers of this disease will demand the most sophisticated medical supportive care available. This demand is primarily because the disease can affect multiple organ systems and because intermittent, technologically-sophisticated treatment can take a patient from near death back to productive life.

The hospitalized patient of today generally requires a higher intensity of care than that rendered 20 years ago. Many root causes underlie this trend. Technical, diagnostic, and treatment techniques have improved to the point that many diseases and procedures, that once could only be handled in hospitals, are now handled on some form of outpatient basis. Insurance carriers often demand that certain procedures be done on an outpatient basis, thereby saving the expense of a hospital stay. Patients have never wanted to be hospitalized if good outcomes are possible with outpatient procedures and medical treatment.

The advent of all the technological advances in hospital care has added an enormous amount of equipment to each room. The hospitalized patient of today almost invariably requires specialized monitoring (cardiac, neurologic, or pulmonary), intravenous therapy, and physical assistance of some sort. Monitoring requires attachment of patient sensors that are connected by wires to a portable transmitter or directly to a monitoring device.

Because of the additional equipment which has been added to each room, current hospital environments offer too much clutter and unavailable floor space and therefore increase risk in the patient's immediate environment. Cluttered hospital rooms, combined with sick or weak patients, lead to a large number of falls in hospitals across the nation each year. The direct cost of falls in hospitals today averages about $1,500.00 per bed per year or $150,000.00 per 100 beds each year. In the United States, the fall incident average is 1.7 falls per hospital bed per year. Five percent of these falls result in some form of serious injury, such as a hip fracture. The cost of these injuries averages between $10,000.00 and $25,000.00. Each of these figures does not include the cost of liability claims, extended rehabilitation, long-term care, lost time for professional staff, or loss of goodwill. With the increase of older patients and nursing staff reductions, the number of falls will only increase.

The design of existing hospital rooms does not contribute to fall prevention. Generally, a patient utility table is in each patient room and the table serves as a surface upon which the patient may place his meal tray, carry on correspondence, work with crafts, or perform grooming tasks. The table is generally cantilevered from a side support member which is in turn supported by a four-wheeled floor base. This arrangement has been necessary because of the need to place the work surface of the table directly over the bed. The physics of the arrangement requires the dimensions of the wheeled floor base to be virtually the same as the dimensions of the table surface. The height of the table surface is adjustable so as to allow the table to be adaptable to various patient sizes, bed heights, and chair use. The main difficulty with the current patient utility tables has to do with the large supporting wheel base. These bases are very difficult to maneuver about the other objects resting upon the floor, such as bed side chests, bed supports, chair legs, and intravenous infusion (IV) stands. Since these utility tables are not used most of the time, they contribute to floor clutter and become impediments to safe ambulation.

IV therapy is now occurring in almost 85% of hospitalized patients. This therapy requires the use of IV stands. All modem hospital beds provide for the use of an IV support pole, and some rooms are equipped with IV supports hung from the wall or ceiling. The IV supports that are attached by a single point to the bed, wall, or ceiling limit severely patient mobility and are generally not used by either patient or staff. Some ceiling-supported IV systems traverse a small distance in a simple linear fashion but do not provide much patient mobility. To address the lack of mobility inherent in other forms of currently used IV stands, a steady trend in IV therapy has been the use of a wheeled IV stand. The wheeled IV stand has many of the same problems as the wheeled utility table. These problems include difficulty in maneuvering within small spaces, difficulty of storage, and interference with patient ambulation resulting from increased floor clutter caused by the presence of the devices supported directly on the floor.

Telemetry transmitters and monitoring equipment such as EKG telemetry, apnea monitors, and oximetry telemetry require the attachment of patient sensors which are connected by wires to a portable transmitter or directly to a monitoring device. Currently the patient must wrestle with these transmitters as he or she tries to rest or sleep. When walking, the patient has to be concerned with transporting the monitor or transmitter along his or her side.

An integrated, expandable system which organizes, stores, and improves the function of these different devices is definitely needed. Preferably, such a system would remove each of these devices from floor spaces in the room and allow immediate accessibility to the devices at all points in the room.

Many patients with neuromuscular diseases and degenerative central nervous system disorders suffer from decreased bed mobility. They find it difficult to turn themselves in bed, or to come to the sitting or standing position from the lying position. Currently, one of the main approaches to facilitation of independent bed mobility is the use of the orthopedic frame equipped with a trapeze. Problems with this device are that it requires installation of the frame upon the bed by an orthopedic technician and it cannot be used anywhere except over a patient's bed. The trapeze is not available for the patient to use to rise from a chair or a portable commode. There is a need to make the trapeze both accessible to all parts of the room, as well as easy to install.

Patients who have impaired ambulation or central nervous diseases which cause difficulties with imbalance now often employ walkers while in their hospital environment. These walkers function fairly well in the home environment, but in the cluttered, cramped hospital environment, they are often not maneuverable enough to offer effective assistance to the gait impaired. Thus, there is a need for a different means of offering support for the gait impaired.

In physical therapy departments, an area is generally set apart for gait training. Currently, this part of physical therapy is very labor-intensive because of the need to have ample personnel present to prevent falls. Rehabilitation of the individual with gait disability (orthopedic or neurologic) who also has significant upper extremity weakness or injury is almost impossible due to the fact that all currently used gait assistance devices require some upper extremity function and strength. For example, a person unable to support himself with his arms is generally not able to walk with the aid of a walker or some form of hand rail. There is a need for a new form of gait assistance which is both reliable and independent of help of others. The device would preferably not rely on floor support for its use.

In the current hospital environment, multiple strategies have been employed to reduce falls. Most hospitals use some form of fall prevention program. The hospitals try to identify patients who have profiles that are known to carry higher risks for suffering falls and institute an appropriate individualized response in the at-risk patient. In some cases, it is as simple as asking the patient not to get out of bed unless assistance is called. This strategy works rather well for the passive, compliant patient, but it fails miserably in the impatient individual or in the confused or forgetful individual. If trouble with compliance with the up-only-with-assistance order is anticipated, other measures may be employed. The simplest and most acceptable measure would be for the patient to be in constant attendance by either a sitter or a family member. However, sitters are expensive and an adequate number of family members is generally hard to find. In addition, human observation fails because humans are not constantly vigilant and tend to become least attentive to the patient fall problem when the problem is most likely to occur: in the middle of the night. Moreover, even the weakest patient can move very quickly at times and falls occur despite the presence of a vigilant observer. Even if the patient's fall is prevented by the observer, there is some risk of injury to the attendant as he or she physically breaks the fall.

Sophisticated monitoring devices that tell the nursing staff when the patient is up and on the move have also been employed to prevent falling. However, these monitoring devices, such as Ambulert®, provide only a simple monitoring function. The devices do not prevent an occurrence, but instead only allow the remote sensing or observation of an activity. Successful fall prevention depends upon timely response by monitoring personnel and sometimes even the fastest response is not fast enough. Thus, this method of fall prevention does not function in a real time mode. Video monitoring also involves a loss of privacy that some individuals find unacceptable.

Various bed rail configurations have also been designed to confine a patient to the bed. The bed rails are user-friendly only to the care givers, and the patient is forced to defeat them in ways that often make the bed rails a threat instead of a help to a patient's safety. Patients climb around, through, and most dangerously, over bed rails to freedom. Short falls turn into dives and the corresponding injuries are more severe. The Posey vest has been implemented to tie a patient to a bed or a chair. Although this vest prevents falls, it works by extracting a tremendous price in loss of patient mobility and dignity. The loss in patient mobility causes corresponding patient morbidity. Because of decreased patient turning and repositioning, there is increased likelihood of skin breakdown due to decreased patient hygiene and pressure damage. Pulmonary toilet is diminished with diminished mobility. Finally and most tragically, the Posey vest is often misconstrued to be a form of incarceration by the individual who is being confined. The misinterpretation as to the motivation for the employment of this safety device often converts a pleasantly confused individual into a belligerent, agitated, and paranoid one. There is a need for a method of supporting a patient so that he or she may be protected from falling out of bed while asleep.

Other patient support apparatus such as patient lifts or bed scales are much less frequently employed but suffer from the same difficulties as other floor mounted devices. For example, the devices in the patents to Asakawa (U.S. Pat. No. 5,072,840) and Vail (U.S. Pat. No. 4,125,908) disclose patient lifting systems. The device in the patent to Twitchell et al. (U.S. Pat. No. 4,243,147) is also a patient lifting device but also includes three-dimensional movement while in the device. The device is intended for moving individuals who are severely afflicted or at least greatly impaired in mobility and require complete lifting. In that manner, the device serves much the same function as a wheelchair, but removes the movable support from the base floor system. The device does not provide enhanced mobility and support for patients who regularly are mobile. These devices also require the active operation of device controls by the patient or the patient's attendant. There is a need for such a device to prevent falls and to increase ambulation in already-mobile patients that operates automatically for the patient.

In summary, there is a need for organization in hospital rooms such that unneeded clutter may be removed from floors. This organization should offer safety for the patient and easy accessibility for hospital staff. In addition, there is a need for an ambulatory support system for a patient which can offer passive restraint. This support system preferably could also support the patient while moving about a room or while sleeping.

SUMMARY OF THE INVENTION

The present invention solves the above problems by providing a patient support system which is designed for enhanced mobility and support and which is intended for patients who are regularly mobile. The device offers an overhead design which enhances mobility and decreases clutter with the effect of reduced falling. The device helps patients with good minds but weakened bodies to raise themselves without a prolonged wait for a nurse. Many patients with diminished judgment and/or defective ambulation can move from a bed to a chair unassisted. However, should a slip occur, the patients would be protected from a severe fall by the passive nature of the support system of this invention.

This invention also provides for attachment of IV equipment and other monitors to the ceiling instead of the bed or floor. This attachment is such that equipment may follow the patient as he moves about the room. Thus, patient mobility is not impaired by attachment of the patient to these devices.

The present invention includes safety support apparatus, for providing ambulatory support to a patient and comprising a support garment wearable by the patient, a tether having a first end and an opposed free end attachable to the support garment, and a support carrier, the first end of the tether is disposed in supported engagement with the support carrier, and the support carrier is capable of applying a support force to the support garment. Furthermore, the tether is disposed in restrained engagement with the support garment adjacent the vertex of the patient's head so that the tether extends substantially from the support garment adjacent to the vertex of the patient's head when a support force is applied to the tether. The support garment may be a vest worn generally about the thorax of the patient with a rigid hood extending from the vest. Alternatively the support garment may include a pillow support harness attachable to the vest and providing a pillow enclosure for disposing a pillow between the pillow support harness and the patient's head and shoulders.

In an alternative embodiment, the present invention further includes a heavy glide rail defining ends thereon and arranged to span between opposite sides of the patient's room, the support carrier being operative to travel back and forth on the heavy glide rail, channels operative for securement in the room for supporting the heavy glide rail such that the heavy glide rail can move therealong and such that the support carrier is capable of movement over a specified region of the room, and a retraction system associated with the support carrier and operative to apply a first upward force to the tether line responsive to a force applied vertically downward by the patient, the first force varying in relation to the downward force applied by the patient and the acceleration of the tether line downward responsive to the downward force such that the first force remains slightly less than the downward force and prevents the acceleration of the tether line downward from reaching a predetermined speed, whereby the retraction system works to decelerate a patient upon falling so that the patient is slowly lowered to the ground.

In still another alternative embodiment the present invention may include an accessory dolly slidably mounted for free travel along the heavy glide rail, the accessory dolly separated from the support carrier and configured so as to releasably receive a peripheral accessory whereby the peripheral accessory may be moved within an area underneath the overhead support system.

Therefore, it is an object of the present invention to provide an overhead support system for a patient.

It is a further object of the present invention to provide a support system which may lend support to an already-mobile patient.

It is an object of the present invention to provide a tether support device that is very safe for use by a patient even while the patient sleeps.

It is another object of the present invention to provide a support garment, to which a tether line attaches, configured to prevent the tether line from coming into contact with the patient about the neck and shoulders.

It is another object of the present invention to provide a support garment, to which a tether line attaches, having a comfortable, non-threatening appearance to provide a high degree of patient, family and staff acceptability of the support garment.

A further object of the present invention is to provide organization in hospital rooms such that unneeded clutter may be removed from the floors.

Another object of the present invention is to provide an overhead support system for supporting patient monitoring equipment.

Yet another object of the present invention is to provide a method of supporting a patient so that he or she may sleep and be supported if he or she falls out of a bed.

Still another object of the present invention is to provide a form of gait assistance which is both reliable and independent of help from others.

It is a further object of the present invention to provide an overhead support system for supporting peripheral accessories in a hospital room accessible to any point within the room.

It is an object of the present invention to provide an apparatus for supporting a patient without the need for the patient to operate device controls to actuate the apparatus.

Other objects, features, and advantages will become apparent upon consideration of the following detailed description of the invention when taken in conjunction with the drawing and the appended claims.

DETAILED DESCRIPTION OF THE PREFERRED EMBODIMENT

Figure 1:
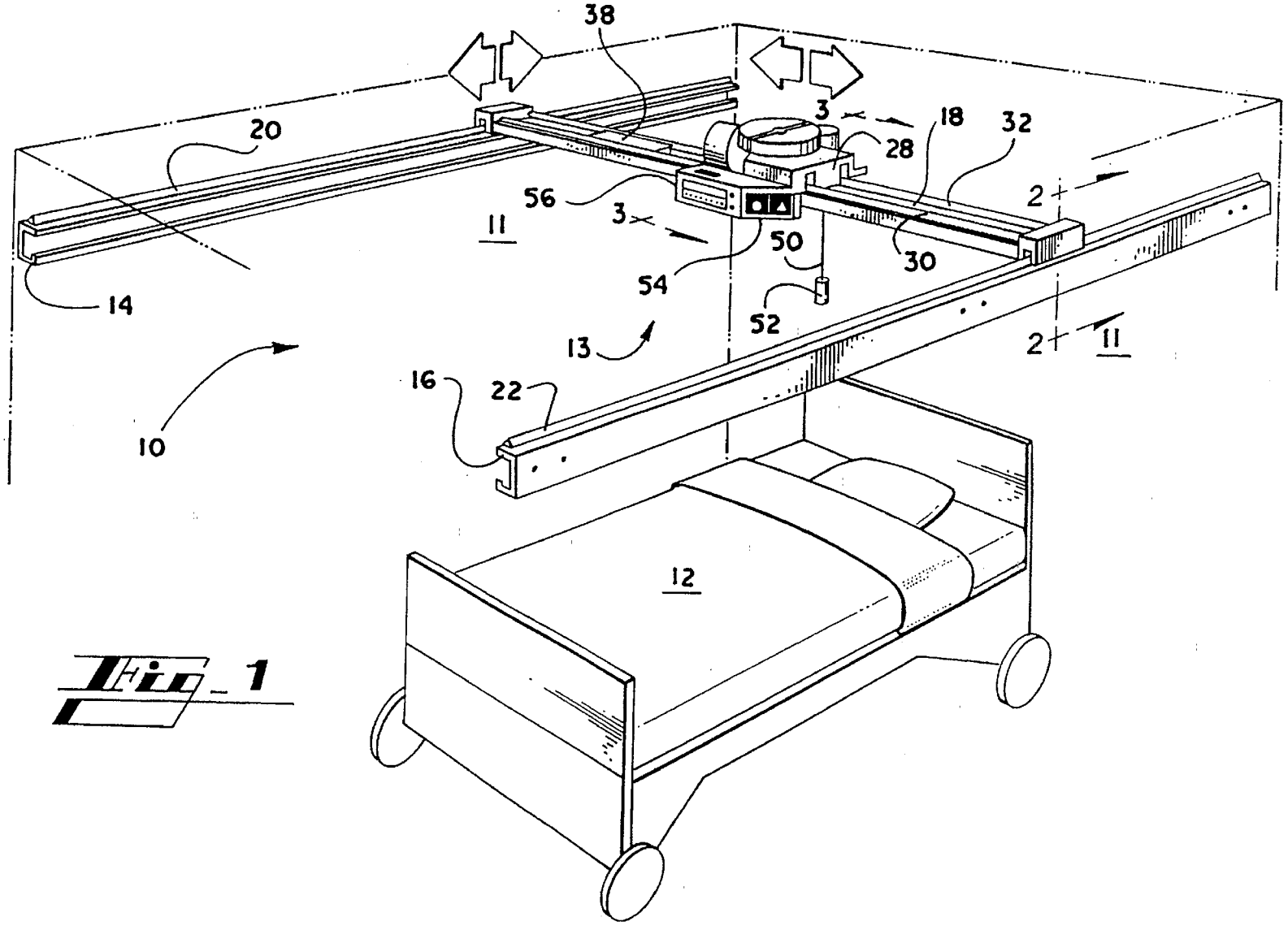
FIG. 1 is a perspective view taken within a room showing the ambulatory support system for a patient, according to a preferred embodiment of the present invention.

Referring now to the drawing, in which like reference numerals represent like parts throughout the several views, FIG. 1 shows a device 10 embodying the ambulatory support system of the present invention. The device is shown installed in a room within walls 11 and over a bed 12. The device includes an overhead system 13 comprising side support rails 14 and 16 and a heavy glide rail 18. The side support rails 14 and 16 are wall mounted adjacent to the ceiling and the heavy glide rail 18 traverses, and is supported by, these rails.

Figure 2:
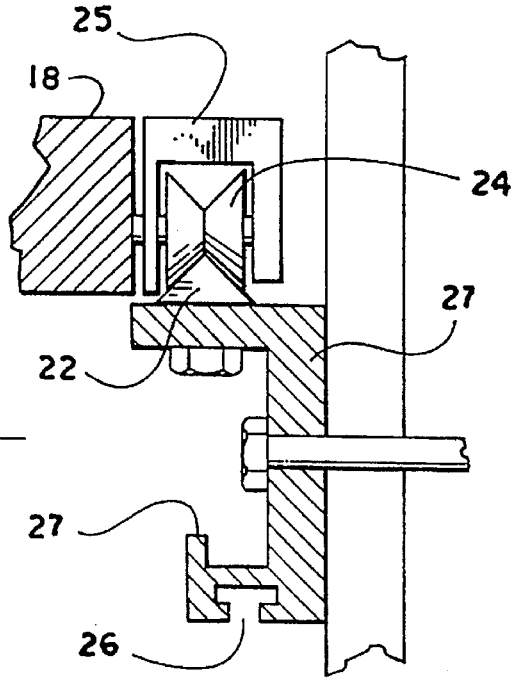
FIG. 2 is a cross-sectional view of the side support rail and the end of the heavy glide rail of FIG. 1 taken along the section line 2—2 of FIG. 1.

FIG. 2 discloses the association between the heavy glide rail 18 and the side support rails 14 and 16. Steel runners 20 and 22 extend along the length of the side support rails 14 and 16. Rollers 24, in end caps 25 on the heavy glide rail 18, engage the runners 20 and 22 on the side rails 14 and 16 such that the heavy glide rail 18 can move freely along the length of the runners 20 and 22. An accessory mount 26 and an upturned flange 27 are located at the bottom of the side support rafts 14 and 16, the use of which will be described in detail below.

A support carrier 28 is mounted for movement back and forth along the heavy glide rail 18. The heavy glide rail 18 includes two laterally spaced-apart runners 30 and 32 which extend along its length on the upper side of the heavy glide rail. As is shown by the cross-sectional view in FIG. 3, rollers 34 and 36, supported for rotation within the support carrier 28, engage the runners 30 and 32 so that the support carrier may move smoothly along the heavy glide rail 18. To give the heavy glide rail 18 a smoother feel, a counterweight 38 may be slidably contained in a longitudinal channel of the heavy glide rail 18 and attached by cable and rollers (not shown) to the support carrier 28. This counterweight 36 is designed to be spaced apart from one of the side support rails 14, 16 a space equal to the distance the support carrier 28 is spaced from the other side support rail.

One or more accessory dollies 40 may be mounted for movement along the underside of the heavy glide rail 18. Each accessory dolly 40 is provided with wheels 41 and 42 which engage tracks within lips on the bottom side of the heavy glide rail 18. The wheels 41 and 42 allow the accessory dolly 40 to be moved easily along the length of the heavy glide rail 18. The accessory dolly 40 includes an accessory mount 43, the use of which will be described in detail below. A tether line 50 extends from one side of the support carrier 28 and includes a quick-disconnect 52, shown in FIG. 7 at its end. The support carrier 28 supports a patient through the tether line 50, as is explained in detail below. The support carrier 28 also includes a condition monitor display 54 and adjustment controls 56.

As shown in FIG. 1, the support carrier 28 may be positioned above any location in the room depicted in the drawing. This is possible because the heavy glide rail 18 allows a complete range of movement in the dimension parallel to the side support rails 14 and 16. The slidable attachment of the support carrier 28 to the heavy glide rail 18 provides movement in the dimension perpendicular to the side support rails 14 and 16.

Figure 3:
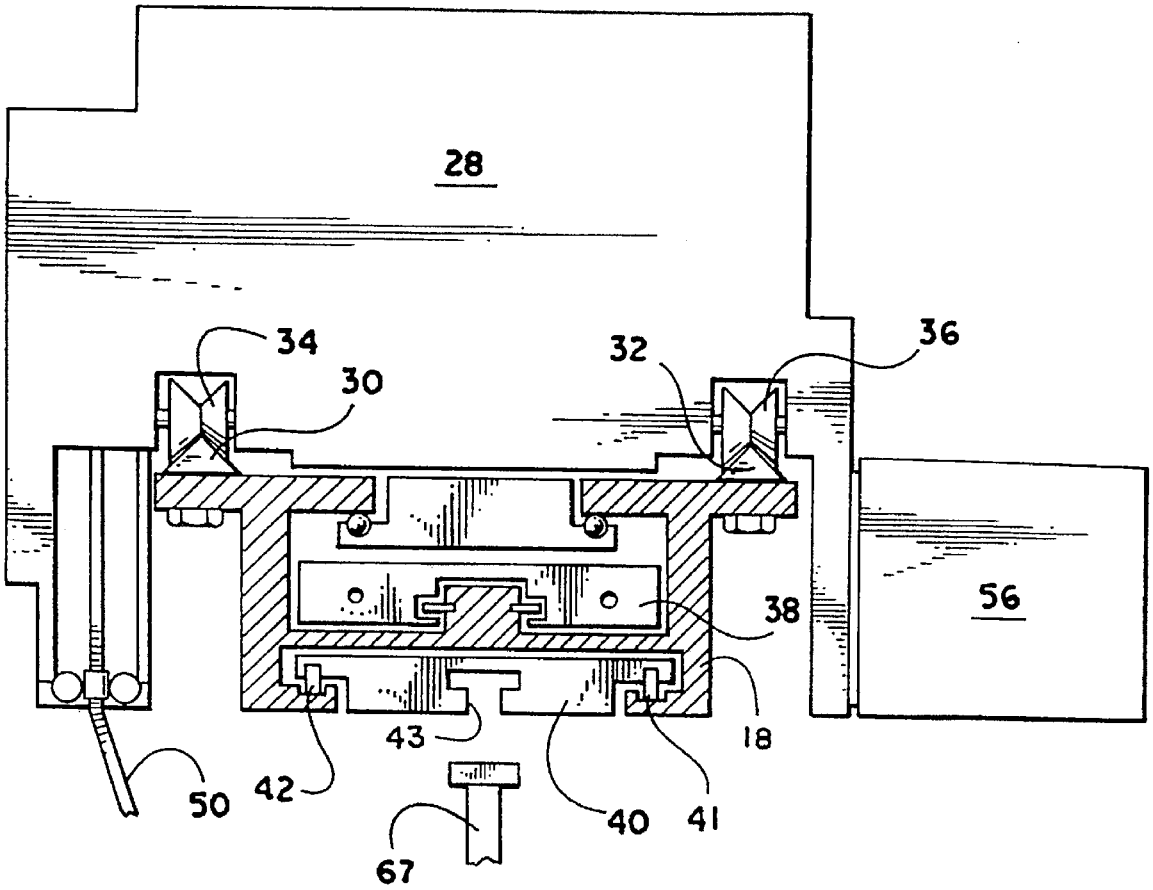
FIG. 3 is a cross-sectional view of the support carrier and heavy glide rail as shown in FIG. 1 taken along the section line 3—13 of FIG. 1.
Figure 4:
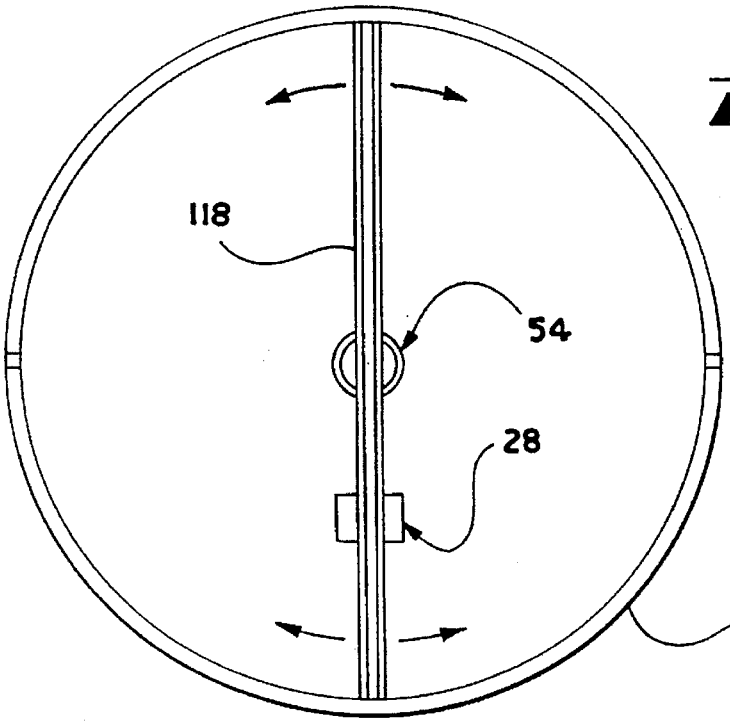
FIG. 4 is a bottom view of an alterative embodiment of the overhead system of the present invention.

An alternative embodiment of the overhead support system shown in FIG. 1 may include a circular side support system 53 with a transversely mounted heavy glide rail 118, as is shown in FIG. 4. The rotating heavy glide rail 118 is mounted across the diameter of the circular track 53 for sliding engagement with a runner (not shown) which is located along the top of the circular track 53. The support carrier 28 is slidingly mounted on the heavy glide rail 118. This system, like the other system shown in FIGS. 1–3, allows the support carrier 28 to be positioned directly above any point within the confines of the fixed track arrangement. The support carrier 28 may slide radially on the heavy glide rail 118 to a needed position, and the rotating heavy glide rail 118 may rotate to a needed orientation. If needed, a rotating central support 54 may be used to support the center of the heavy glide rail 118.

Figure 5:
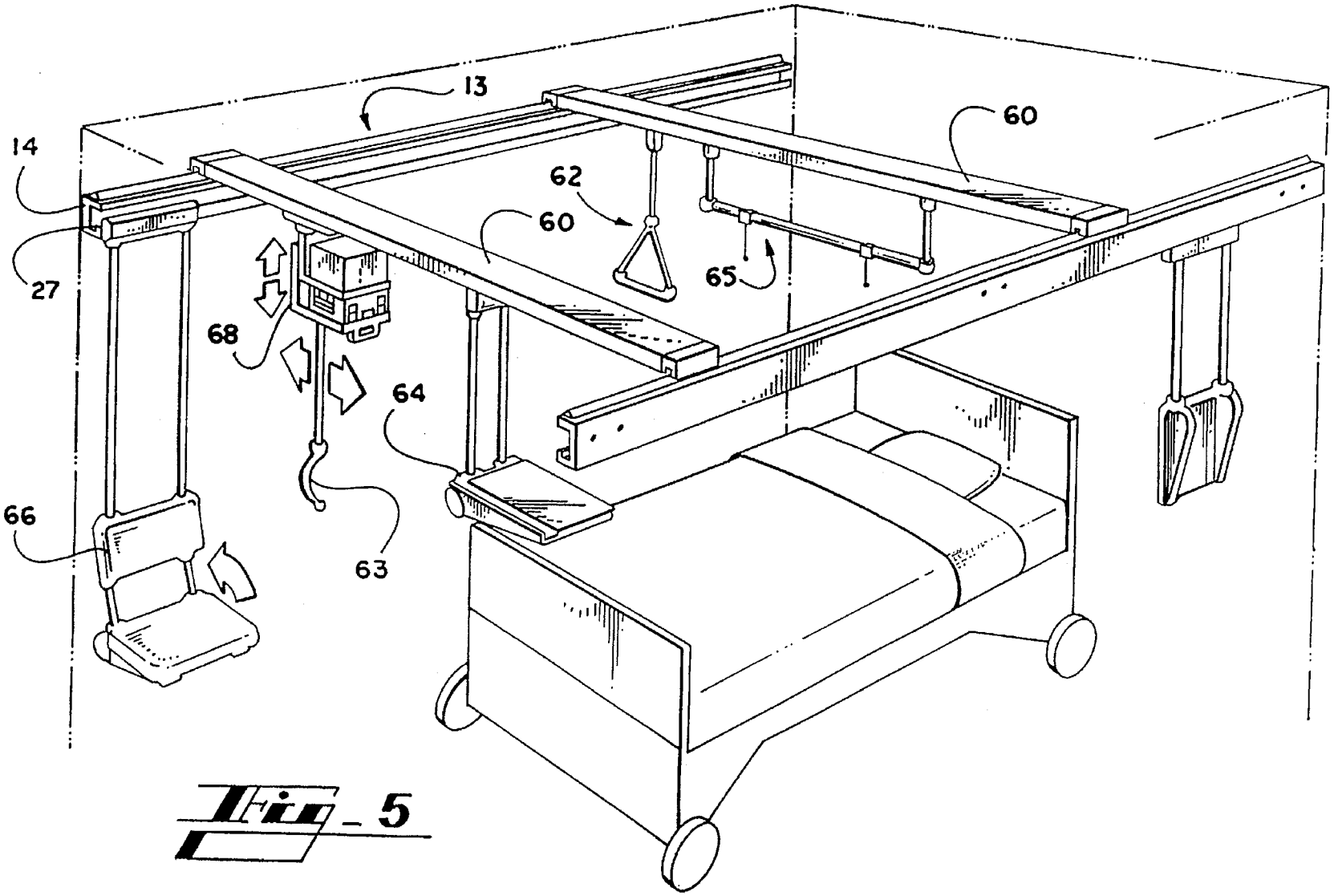
FIG. 5 is a perspective view of an alternative embodiment of the present invention showing different accessories which may be added to the overhead support system of FIG. 1.

In addition to the system of patient support supplied by the support carrier 28, the overhead support system 13 of the present invention may suspend any number of patient care devices. Several such devices are depicted in FIG. 5. Additional transverse tracks which serve as light accessory rails 60 may be mounted within the overhead support system 13 for suspending various equipment from the overhead support system 13. For example, a trapeze 62 may be suspended above a bed from one of the fight accessory rails 60. Also, a fold-up table 64 may be suspended from the rails 60 which allows the table 64 to be used and then easily stored out of the way at a later time. The fold-up table 64 is supported by an adjustable mount which allows the height of the table 64 to be adjusted suitable to a patient. An orthopedic traction set-up 65 or a walker (not shown) may also be provided. Likewise, a fold-up chair 66 may be adapted for use with the overhead support system. The fold-up chair 66 shown in FIG. 5 is mounted on the upturned lip 27 of the side support rail 14. Preferably, however, the accessories, such as the trapeze 62, are mountable to the accessory dolly 40 (as shown in FIG. 3 and as is described in detail above), so that they may have free movement in two dimensions about the room. The accessory dolly 40 is adapted to receive an end 67 which extends from the accessory. The dimensions of the end 67 are configured to allow the end 67 to be inserted into the mount slot 43 in one orientation and then locked into position (as shown in FIG. 3) by a one-quarter turn of the end 67. The accessory is removed by another one-quarter turn of the end 67. Locking means (not shown) are provided to prevent unintended disengagement of the end 67 from the accessory mount 43. At other times, when the accessories are not being used, they may be stored in the bottom of the side rail in the accessory mounts 26 as shown in FIG. 2.

The light accessory rails 60 may be provided with rail locks (not shown) to lock the light accessory rails 60 against movement relative to the heavy glide rails 18. Locking the light accessory rails 60 against movement may be desirable or necessary, such as when the light accessory rails 60 are used to support the traction set-up 65.

Another accessory which may be mounted in the overhead support system 13 of the present invention is an IV fluid reservoir/pump 68. This pump 68 may be mounted such that it may be moved up and down its support. This allows the IV fluid/reservoir/pump 68 to be raised up near the ceiling to be stored in an unobtrusive manner and then lowered to set or refill it. The IV pump/reservoir 68 may also be disengaged from the overhead support to allow the IV pump/reservoir 68 to be transferred to a wheel drain IV pole or a wheeled stand. A hand grip 63 may be adapted to the IV pump/reservoir 68 so that the position of the IV pump/reservoir 68 may be easily changed by the patient.

Figure 8:
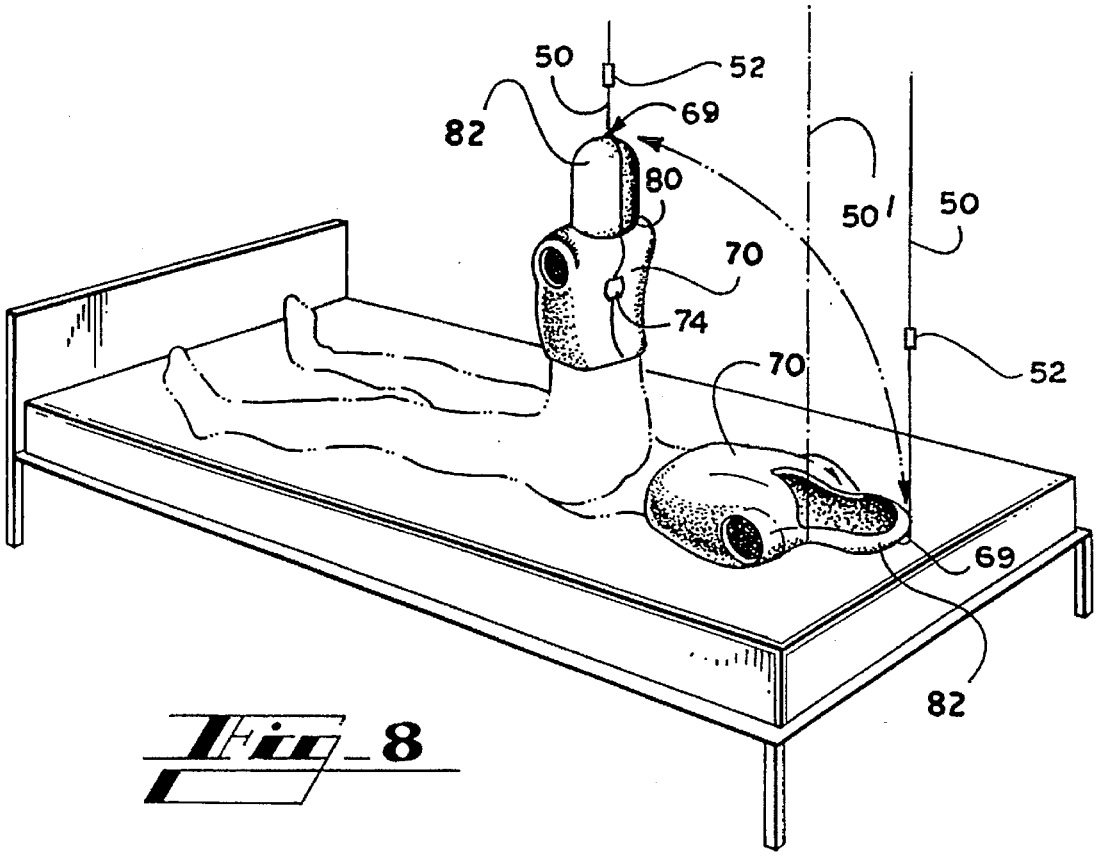
FIG. 8 is a perspective view of the vest of FIGS. 5 and 6 with an added sleeping cowl showing the positioning of a patient in the prone and sitting up positions.
Figure 7:
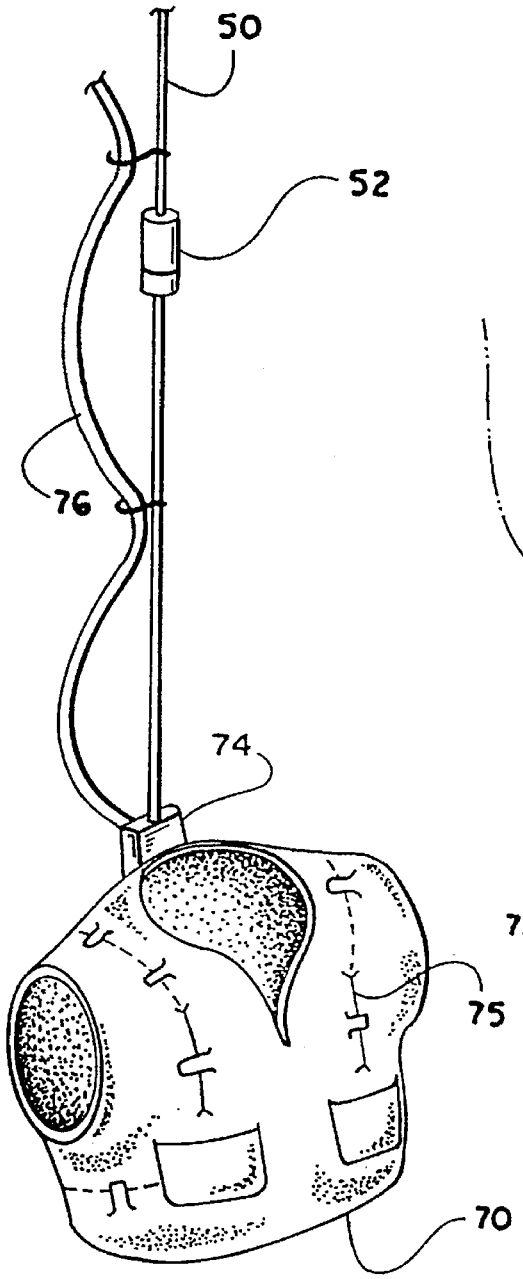
FIG. 7 is a perspective view of the vest of FIG. 5.
Figure 6:
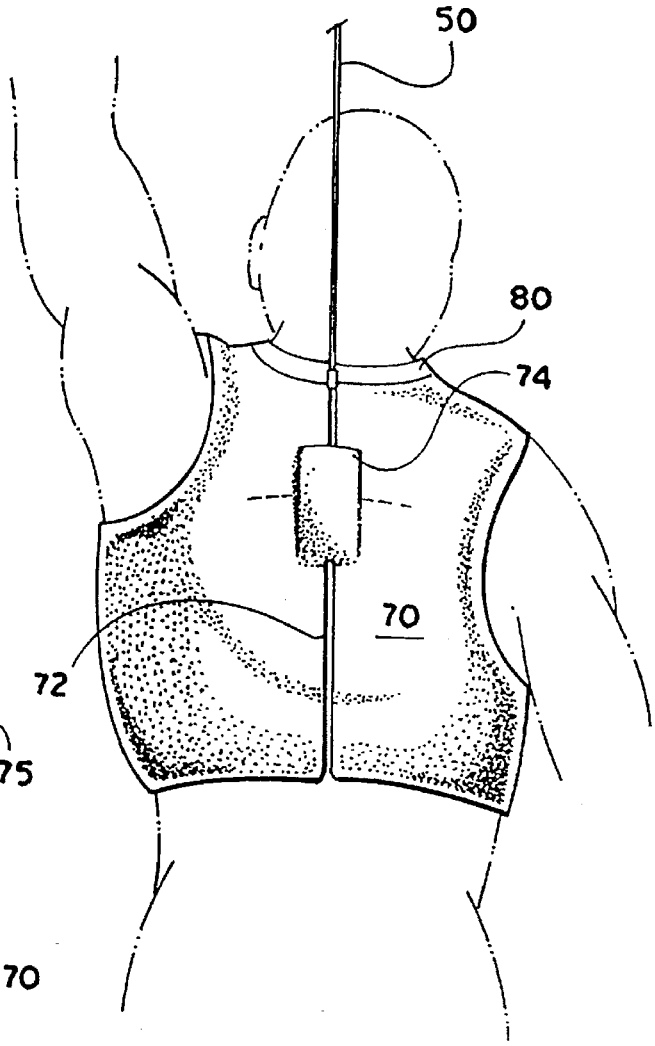
FIG. 6 is a rear view of a support vest for the present invention, which serves as a support garment for a patient.

FIGS. 6–8 disclose an embodiment of a preferred suspension garment or support garment of the present invention. FIG. 6 shows the rear view of a day vest 70 of the present invention worn by a patient about the thorax portion of the patient's body, although other configurations and wearing locations are within the contemplation of the present invention. The vest 70 includes an adjustable closure 72 along the spine of the patient and an attachment point 74 for the tether line 50. As shown in FIG. 7, an umbilical cord 76 may be provided which carries patient care or monitor lines to the patient. The tether line 50 includes a quick-disconnect 52 so that the patient may be disconnected quickly from the ambulatory support system 10. As is shown in FIG. 7, the vest 70 includes indentations and holders 78 for providing patient care and monitor lines or attachments to the patient. An attachment 80 extends along the back of the day vest 70 for attaching a hood 82 to be worn while the patient is in the recumbent position. This hood 82 is shown in detail in FIG. 8. The hood 82 is preferably made of a combination of rigid, semi-rigid, and flexible materials and is designed so as to extend around the back of a patient's head and upward to the top or vertex of the head. This rigid system assists in keeping the tether line 50 away from the neck and shoulders of a recumbent patient.

A tether retainer 69, which resembles a "D" ring in one embodiment, is attached to an upper portion of the hood 82 in a conventional manner. The tether line 50 is extended through the tether retainer 69 prior to attaching the tether to the attachment point 74. The tether retainer 69 is effective to cause the tether line 50 to extend upwardly along the hood 82 from the attachment point 74 to prevent the tether line 50 from slipping around the sides of the hood 82. If the tether line 50 were to slip to the side of the hood 82, as indicated by the dashed line 50' in FIG. 8, a bearing force could be applied about the neck and shoulders of the patient. This condition would defeat the purpose of the hood 82 and could be uncomfortable for the patient.

The tether line 50 is not rigidly attached to the retainer 69 because it is desirable to transmit the supporting forces to the vest 70 directly rather than through the hood 82 and the attachment 80. By allowing longitudinal movement of the tether line 50 through the tether retainer 69, but no lateral movement, the supporting forces are transmitted to the point of attachment 74 and into the vest, which is better adapted to resist the supporting forces. If the hood 82 and the attachment 80 were to fully carry the support force, these components would have to be made more robust and rigid than if the support forces were carried directly by the vest 70. The more rigid the hood 82 is made, the less comfortable and the more aesthetically displeasing it becomes.

Looking now at FIGS. 12–16, there is shown a pillow support harness 71 which serves to connect the tether line 50 to the vest 70 worn by a patient. The pillow support harness 71 is useful to support the patient when the patient is moved, or moves, from a supine position to a sitting position in bed. The pillow support harness is also useful for supporting the patient as the patient gets out of bed and walks about the room. The pillow support harness 71 is adapted to enfold a pillow for the safety and comfort of the patient, particularly while the patient is in a recumbent position and unattended, such as when the patient is alone and sleeping.

Figure 12:
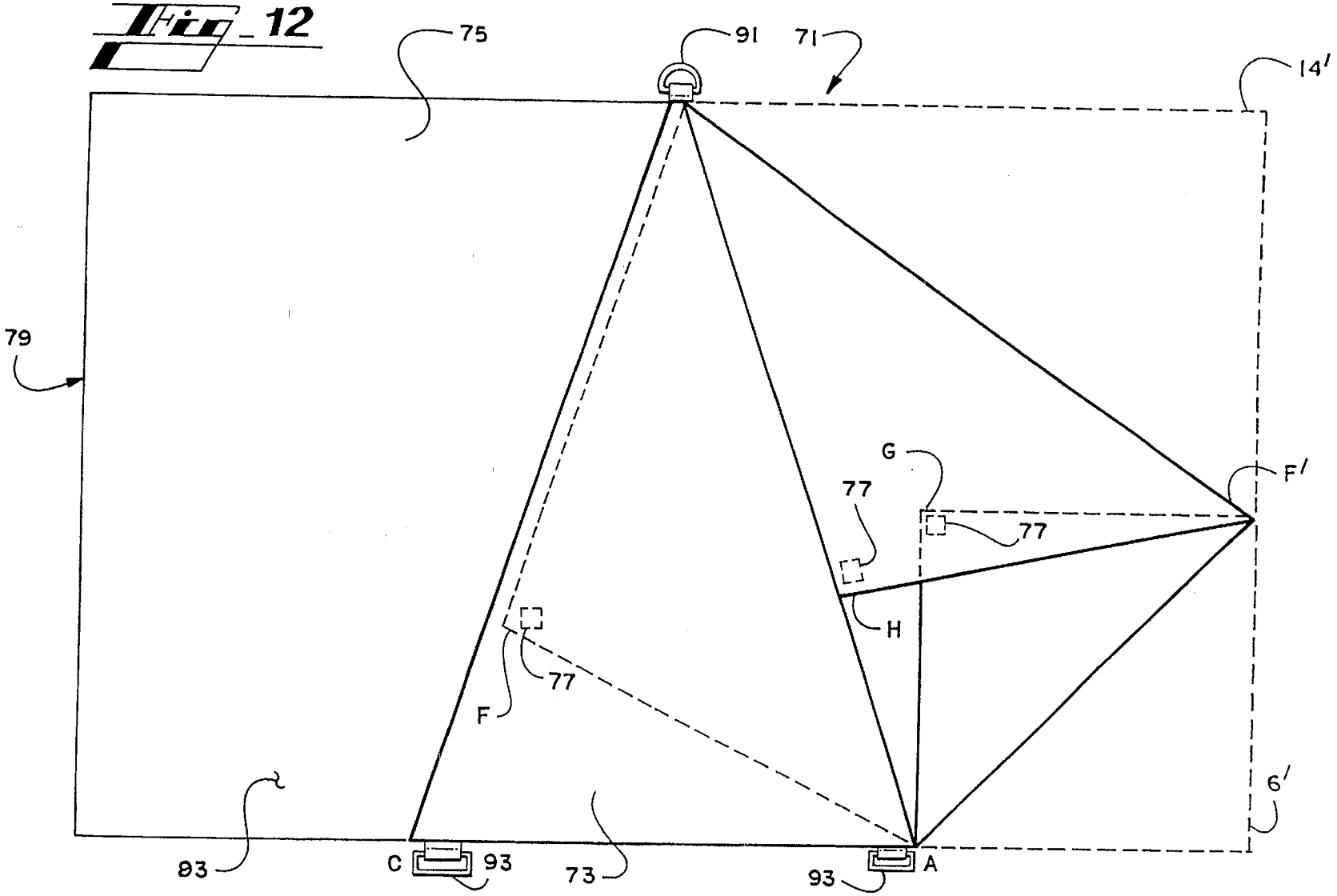
FIG. 12 is a front view of a vest with a sleep pillow harness attached to the vest, the sleep pillow harness being shown in phantom lines in the sequential stages of unfolding to provide a sleep pillow case.

The pillow support harness 71 includes a pillow enclosure 79 which may be used in either of two configurations as shown in FIG. 12. In a first configuration, portions of the pillow enclosure 79 are folded over to provide a simple triangularly shaped harness structure 73. The triangular harness structure 73 is shown in FIG. 12 and is bounded by the line segments a-b, b-d and d-a. In a second alterative embodiment, the pillow enclosure 79 is disposed in an unfolded configuration to provide a rectangular pillow enclosing structure 75, which is represented by the line segments A-B, B-C, C-D and D-A.

The unfolding sequence of the pillow support harness 71, from the triangular harness structure 73 to the pillow enclosing structure 75 is depicted in FIG. 12. The left side of the pillow enclosure 79 is shown fully unfolded and the fight side is shown folded. It is to be understood that, when the pillow support harness 71 is disposed in the triangular harness structure 73 configuration, the left side of the pillow enclosure 79 is folded over the right side of the pillow enclosure 79 in the fight side's folded configuration. The first step for unfolding the folded portion of the pillow enclosure 79 includes the step of unfolding overfolded portion F to F' about the fold line a-b. This reveals folded over corner portions G an H. Corner portion H is unfolded about fold line b-d to H'. Then, corner portion G is unfolded about fold line a-d to G' thus providing the fully unfolded pillow enclosure 79.

Fasteners 77, such as snaps or, preferably, hook and loop fasteners commonly referred to as Velcro® fasteners, may be attached at selected comers of the folded portions of the pillow enclosure 79. The fasteners 77 assist in folding the pillow enclosure 79 from the pillow enclosing structure 75 to the triangular harness structure 73. The fasteners 77 also help maintain the pillow support harness 71 in the triangular harness structure 73. The fasteners 77 may optionally be color coded to help insure that the pillow enclosure 79 is properly folded into the triangular harness structure 73. For example, the component portions of the hook and loop fastener attached to portion G may be green in color. The other fasteners attached to portions H and F are different colors, such as red and blue, respectively. Thus, when the pillow enclosure 79 is being folded into the triangular harness structure 73, the corner portion G is folded over and the green fastener component attached to portion G is engaged with a mating green fastener component attached to the pillow enclosure 79. If the fastener components 77 were not color coded, the fastener component 77 attached to the corner portion G could be incorrectly engaged with one of the other mating fastener components. This would result in an improperly folded pillow enclosure 79 which may not provide optimal support for the patient. By color coding the fasteners, such errors are avoided.

Figures 13, 14, 16:
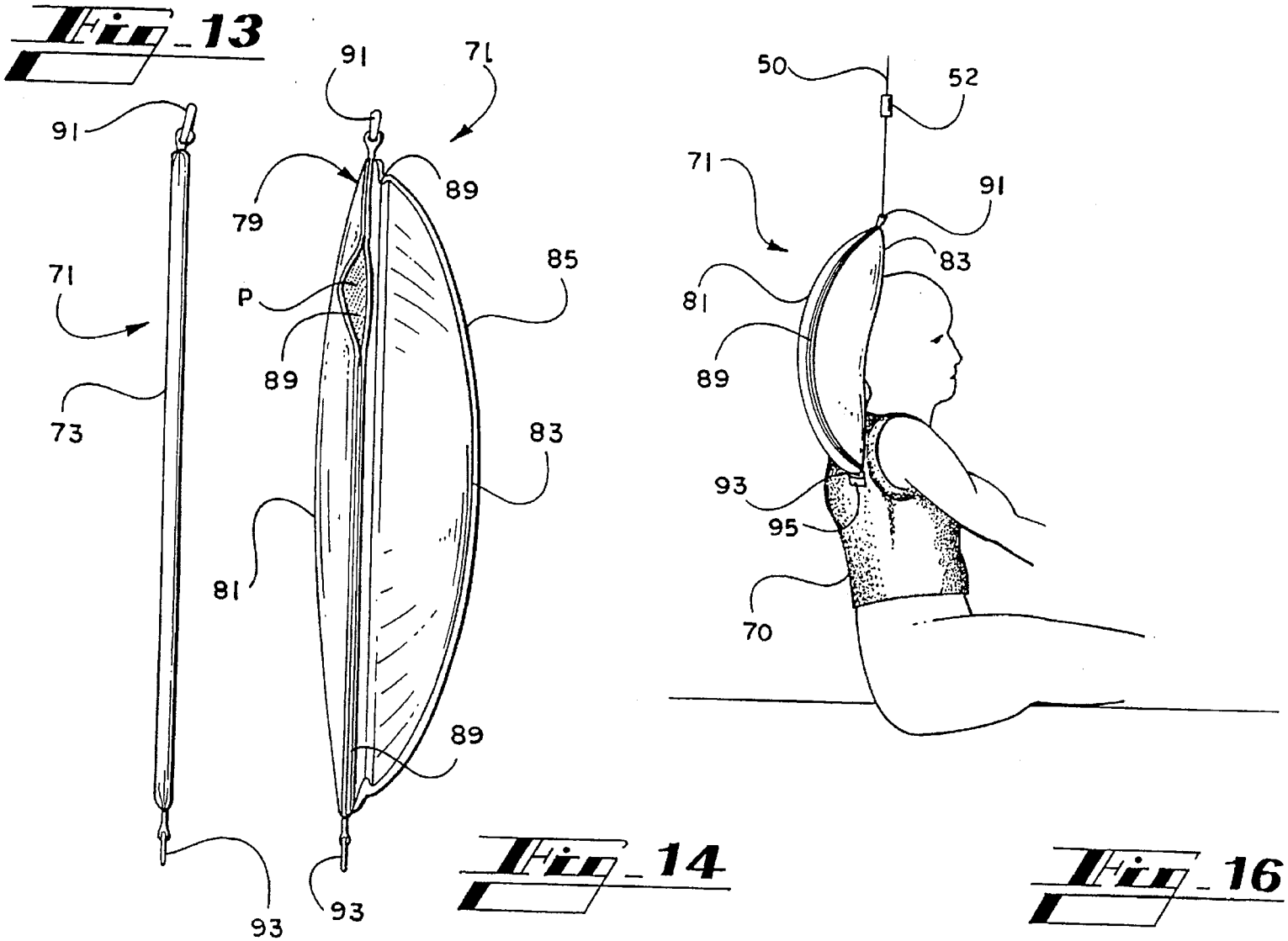
FIG. 13 is a side view of the sleep pillow of FIG. 12, shown folded-up into the triangular shaped sleep harness.
FIG. 14 is a side view of the sleep pillow of FIG. 12, shown unfolded and with a pillow enfolded within the sleep pillow case.
FIG. 16 is a side view of the patient shown in FIG. 15 urged into a sitting position on the bed by tensioning the tether line 50.
Figure 15:
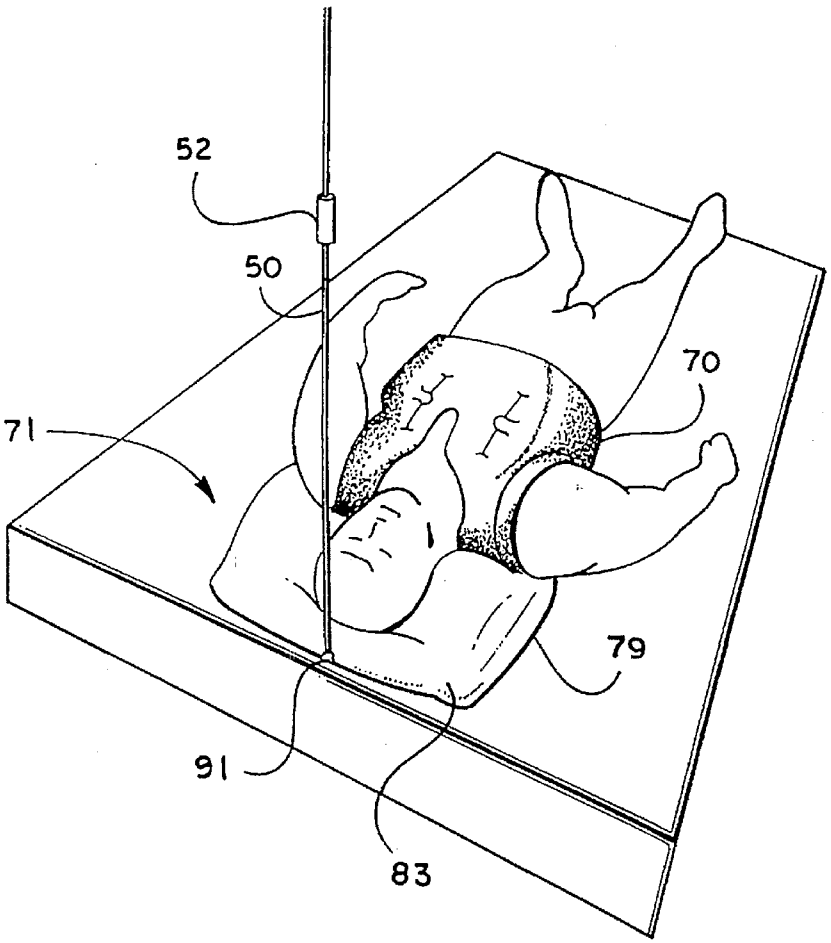
FIG. 15 is a pictorial view of a patient lying supine on a bed with head supported upon the sleep pillow appliance with a pillow enfold within the sleep pillow case.

As is shown in FIGS. 12 and 14, the pillow enclosure 79 includes a back panel 81 and a front panel 83. The front panel 83 faces the patient during normal use. The back panel 81 and front panel 83 are joined along three sides to form a case opening 89, shown partially open in FIG. 14, through which a pillow P is inserted into the pillow enclosure 79. In one embodiment, for example, the back panel 81 and the front panel 83 may be permanently joined along the upper and lower opposed edges and along one of the side edges leaving the opposed side edge of the pillow enclosure 79 open as shown in FIG. 14. Alteratively, the back panel 81 and the front panel 83 may be permanently joined along the opposed left and right side edges and additionally along the lower edge leaving the opposed upper edge of the pillow enclosure 79 open for pillow insertion (not shown). The opening 89 of the pillow enclosure 79 is made to be selectively closable by attaching a closing device such as cooperating hook and loop fastening tape along inside surfaces of the back and front panels 81 and 83 adjacent the opening 89. After the pillow is inserted into the pillow enclosure 79 the open end 89 is closed by pressing the hook and loop components together.

The back panel 81 is fabricated of a heavy fabric such as a heavy cotton duck cloth. The exterior side of the back panel 81 may be coated with a slippery material, such as vinyl, to allow the back panel 81 to move freely of the bed sheets when the pillow enclosure 79 is repositioned for the patient's comfort.

The front panel 83 is fabricated of a lighter and finer grade of fabric which provides a pillow case material which the patient may engage directly with his head and shoulders. Alteratively, the front panel 83 may be fabricated of a more sturdy material that is strong yet supple. For example, the front panel 83 may be fabricated of a vinyl impregnated fabric which is durable, supple and easily cleaned but not suitable for direct patient contact. In the case where the front panel 83 is fabricated of a more sturdy fabric, a case cover 85, is attached to and covers the front panel 83. The case cover 85 is fabricated of a material suitable for use as a pillow case i.e., it is suitable for direct contact with the patient's face and shoulders. The case cover 85 protects the front panel 83 from becoming soiled yet at the same time provides a material surface which is comfortable to the patient user. The case cover 85 may also be disposable. The case cover 85 may be fabricated of a rectangularly shaped, single ply cotton sheet attachable to the front panel 83 by hook and loop fastener strips applied along the opposed peripheral edges of the front panel 83 and the case cover 85.

The front panel 83 is provided with expansion pleats 87 which extend adjacent the edges of the front panel 83. The expansion pleats 87 extend to allow the pillow enclosure 79 to expand in volume to accommodate the pillow P inserted into the pillow enclosure 79. When the pillow P is not inserted into the pillow enclosure 79, the expansion pleats 87 retract so that the front panel 83 folds flat against the back panel 81 which facilitates folding the pillow enclosure 79 into the triangular harness structure 73. The front panel 83, rather than the back panel 81, is provided with the expansion pleats 87 so that the protuberance of the pillow enclosure 79, caused by an inserted pillow, will be biased toward the patient.

A tether attaching ring 91 is attached to the back panel 81 at the apex of the triangular harness structure 73. Vest attaching rings 93 attach to the back panel 81 at the base of the triangular harness structure 73. Cooperating attaching rings 95 are mounted on the vest 70 and are positioned such that when the vest attaching rings 93 are engaged with the attaching rings 95, the base of the triangular harness structure 73 mounts at about the level of the superior borders of the scapulae, bilaterally. In one embodiment of the present invention, the attaching rings 91 and 93 may be rectangularly shaped wire rings or "D" rings. The tether line 50 attaches to the tether attaching ring 91 so that a support force may be applied to the patient. The tether line 50 may be permanently engaged with the attaching ring 91 and the patient released from the tether line 50 by disengaging the quick-disconnect 52. Alteratively, a snap hook may be permanently attached to the tether line 50 and the snap hook engaged with the attaching ring 91.

The pillow support harness 71 is sized so that the apex of the triangular harness structure 73 is at a height relative to the patient so as to clear the vertex of the patient's head when the patient vest 70 is being worn with the tether line 50 attached to the tether attaching ring 91 and supporting force is applied to the tether line 50. This attaching arrangement minimizes potential twisting of the tether line 50 about the patient's neck and divides suspension forces between two points located near natural anatomic support points for the body, that is, the armpits. The triangular shape of the pillow support harness 71 in the triangular configuration 73 and the location of the points of attachment of the vest attaching rings 93 to the vest attaching structures 95 minimize the appearance of the pillow support harness 71 from the frontal view. This configuration improves the patient's comfort, has aesthetic appeal and improves acceptance of the device by the patient and friends and family of the patient.

Suspending forces applied by the tether line 50 to the tether attaching ring 91 are carded substantially by and transmitted through the back panel 81 and to the vest attaching rings 95. The patient's head and shoulders are supported and separated from the back panel 81 by the pillow interposed between the patient and the back panel 81, when the pillow support harness 71 is in the unfolded configuration with a pillow P inserted in the pillow enclosure 79. Thus, the support forces are distributed about the patient's head and shoulders and tend not to wrench the patient's head forward when support forces are applied. Because the tether line 50 attaches at the attaching ring 91 rather than at a point lower than the attaching ring 91, such as at the point of attachment 74 as shown in FIG. 8, the tether line 50 is prevented from coming into contact with neck and shoulders of the patient. Because the pillow support harness 71 is not a rigid structure, it is necessary that the tether line 50 is attached to the tether attaching ring 91 rather than simply run through the ring 91. This prevents movement of the attaching ring 91 down the tether line 50 so that the pillow support harness 71 does not collapse or fall down about the patient's neck and shoulders, due to its supple construction. Thus, the tether line attaching ring 91 retains the tether line 50 adjacent the vertex of the patient's head when a support force is applied to the tether line 50. This attaching arrangement increases the effectiveness of the device and the comfort and safety of the patient.

Figure 17:
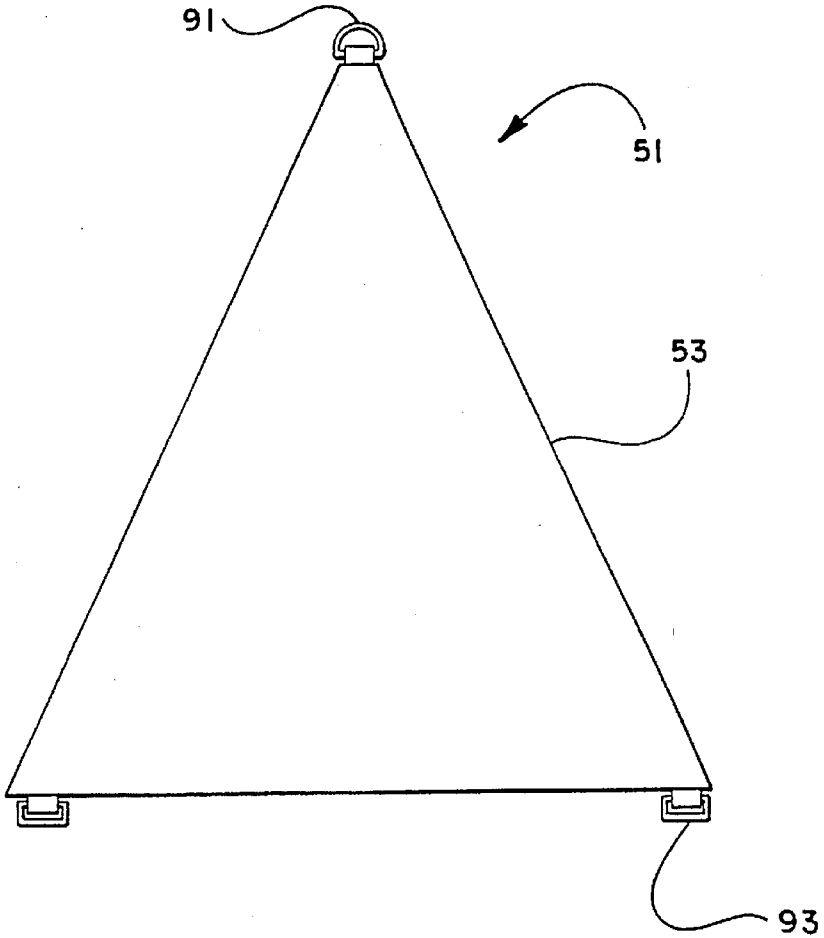
FIG. 17 is a pictorial view of a generally triangular support structure providing an alternative support harness for supporting a patient.

An alternative support arrangement to the hood 82 and the pillow support harness 71 is shown in FIG. 17 and includes generally a triangularly shaped shoulder harness 51. The shoulder harness 51 is similar to the pillow support harness 71 with the exception that the shoulder harness 51 includes no pillow enclosure 79. The shoulder harness 51 comprises a triangularly shaped harness body 53 which comprises a sheet-like heavy cloth or non-woven material. Tether and vest attaching rings 91 and 93, respectively, are attached at the comers of the shoulder harness 51 similar to the pillow support harness 71. The shoulder harness 51 attaches to the vest 70 through the vest attaching rings 95. The tether line 50 attaches to the tether attaching ring 91. The shoulder harness 51 is particularly useful where the added comfort provided by the pillow enclosure 79 of the pillow support harness 71 is not needed and the slight bending movement that the shoulder harness 51 causes is not objectionable.

The support force applied to the tether line 50 transfers through the shoulder harness 51 or the pillow support harness 71 and into the vest 70. Because the support carrier 28 is maintained in position substantially directly above the patient as the support force is applied to the tether line 50, there is only very slight pressure applied against the rear of the patients head. Only a slight bending moment is applied about the patients neck. The bending moment is greatest when the patient is in a supine position on the bed, and the least when the patient is in full sitting position. The bending moment increases as the patient tends from the sitting to the fully supine position. This support arrangement mimics lifting a patient adjacent the armpits.

Within the support carrier 28 of the present invention is a retractable cord system. This retractable cord system is similar to that used for seat belts; that is, the system pulls in the tether line 50 when no downward pressure is applied to the end of the tether fine and allows pulling of the tether line outward when a slow, even downward pressure is applied to the end of the tether line. However, if downward pressure is applied quickly, such as when a patient falls down or, in the case of a car seat belt, when an accident occurs, the retractable system locks in place and does not allow any of the tether fine to be let out.

Preferably, the retractable system offers at least two forces which prevent the tether line 50 from being let out or causes the tether line 50 to retract back into the support carrier 28. The first force supplied by the retraction system is applied only when a downward force is applied to the tether line 50. This type of situation occurs when the patient connected to the tether line 50 falls down. The first force varies in relation to the amount of downward force applied to the tether line 50, and the acceleration of the line downwardly. Thus, the first force acts as an opposition to release the tether line 50 and is responsive to a force which is applied downward on the tether line.

The second force keeps the tether line 50 taut when the patient is in one of the support garments, such as the day vest 70, the sleeping hood 82 or the safety pillow 71, and is attached to the tether line 50. The tether line 50 remains extended from the support garment to the support carrier 28 in a substantially vertical orientation. This second force is inadequate to fully support the patient, and generally is used to keep slack from being formed in the tether line 50. However, the second force may supply a minimal amount of support for the patient. This second force is less than the force needed to lift the patient and therefore may be used to give partial support to a weakened patient at all times. This force remains constant regardless of how much of the tether line 50 has been let out. Thus, as is shown in FIG. 8, the tether line 50 remains substantially vertical, and adjusts accordingly when a patient sits upward in his bed while wearing the sleeping hood 82. This second force urges the support courier 28 into position directly over the patient. By maintaining the support carrier 28 directly overhead a straight upward force is exerted on the tether line 50. If the patient happens to fall the patient support forces of the tether line act vertically upwards rather than act oblique to the patient with the tendency to cause the patient to swing toward the location directly below the support carrier 28.

Preferably, the first force and the second force remain slightly less than the downward force applied by the patient so that the retraction system may work to decelerate a patient upon falling so that the patient is slowly lowered to the ground. The forces are regulated so a to ensure timely descent to the floor so as to prevent decreased cerebral blood flow in cases of fall due to circulatory failure (such as fainting or cardiac arrest). Regulating the forces in this manner also prevents inadvertent strangulation should the tether line 50 become entangled about the neck. The retraction system may include a third force which may be applied to lift the patient upon hitting the ground. This third force may be activated by the adjustment controls 56.

Figure 9:
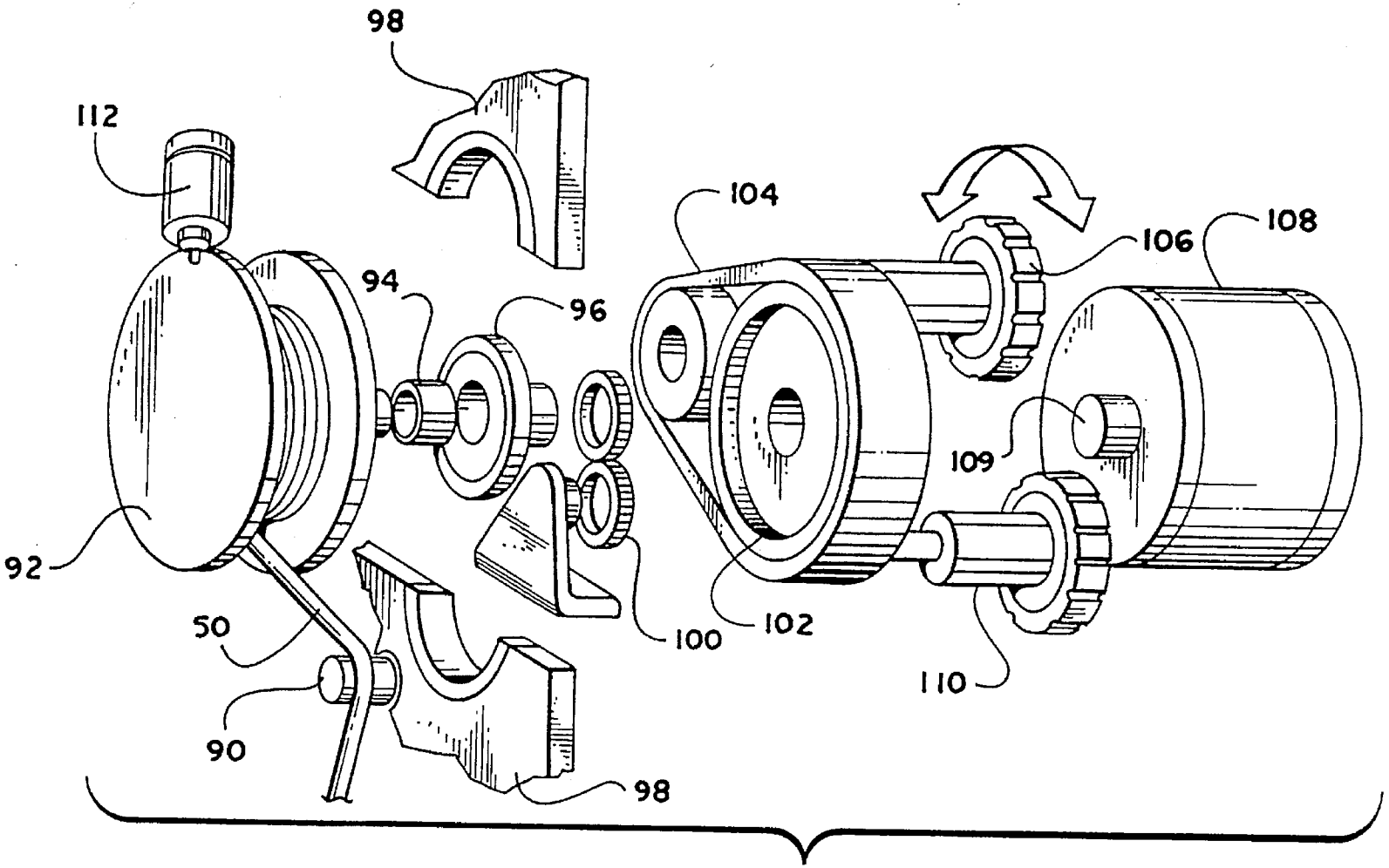
FIG. 9 is an exploded perspective view of the internal mechanism for at least one embodiment of the support carrier of FIG. 1.

A preferred method of providing the retraction system of the present invention is depicted in FIG. 9. As can be seen from the drawing, the tether line 50 extends over a non-twist mechanism 90 so that it may extend downwardly to the patient. The other end of the tether line 50 is wound about a spring recoil and takeup reel 92. The spring recoil in this takeup reel 92 applies the second force through the tether line 50 and makes sure the tether line 50 is taut. The takeup reel 92 extends into a one-way bearing 94 which allows the takeup reel 92 to freely spin in the direction of recoil. The one-way bearing 94 is located within a bearing housing 96 which in turn is held in place in an enclosure 98. The end of this bearing housing 96 is associated by gears 100 to a flywheel 102. It is this gear reduction and the tension in the flywheel 102, created by a flywheel friction belt 104, that applies the first force to the tether line 50. The speed at which the bearing housing 96 and therefore the takeup reel 92 may rotate is determined by the speed of the flywheel 102 rotating about its central axis. This speed is impeded by the friction belt 104 and is greatly reduced through the gears 100. Thus, when a downward force is applied to the tether line 50, the takeup wheel is tamed in a counterclockwise rotation in FIG. 8 which allows the one-way bearing 94 to turn in its proper direction and, in turn, turns the bearing housing 96. This turning is impeded by the resistance of the flywheel 102 to rotating about its axis. The resistance of the flywheel 102 to rotation may be increased by a belt tension adjustment knob 106, which is set to offset a patient's weight. On the support carrier 28, the belt tension adjustment knob 106 may be located with the adjustment controls 56.

A motor 108 may be supplied which extends through the flywheel 102 and applies the third force described above. The rotation of the shaft 109 of this motor is independent of rotation of the flywheel 102. A flywheel lock pin 110 is provided to lock the motion of the flywheel 102, allowing the motor 108 to provide controlled lift through the takeup reel 92. The one-way bearing 94 allows free spinning of the takeup reel 92 relative to the bearing housing 96, and therefore the flywheel 102 and bearing housing 96 are not spinning during motor operation. In this manner, the motor 108 may supply any amount of lift to lift the patient above the ground or to apply a continuous force to the patient such that the tether line 50 may give a minimal amount of support to the patient. This minimal amount of support would be in addition to the tension provided by the takeup reel 92 and would be part of the second force described earlier. A patient position sensor 112 may be employed so that the support carrier 28 may be moved electronically or mechanically, responsive to movement of the patient. The patient position sensor 112 may be adapted to provide an electrical output signal comprising patient position information such as the position of the support carrier in a horizontal plane and the extension length of the tether line 50. This information, which provides some indication of the patient's three dimensional position in the room, could then be transmitted to a central monitoring system (not shown) to provide an additional safety device to further protect the patient.

Figure 10:
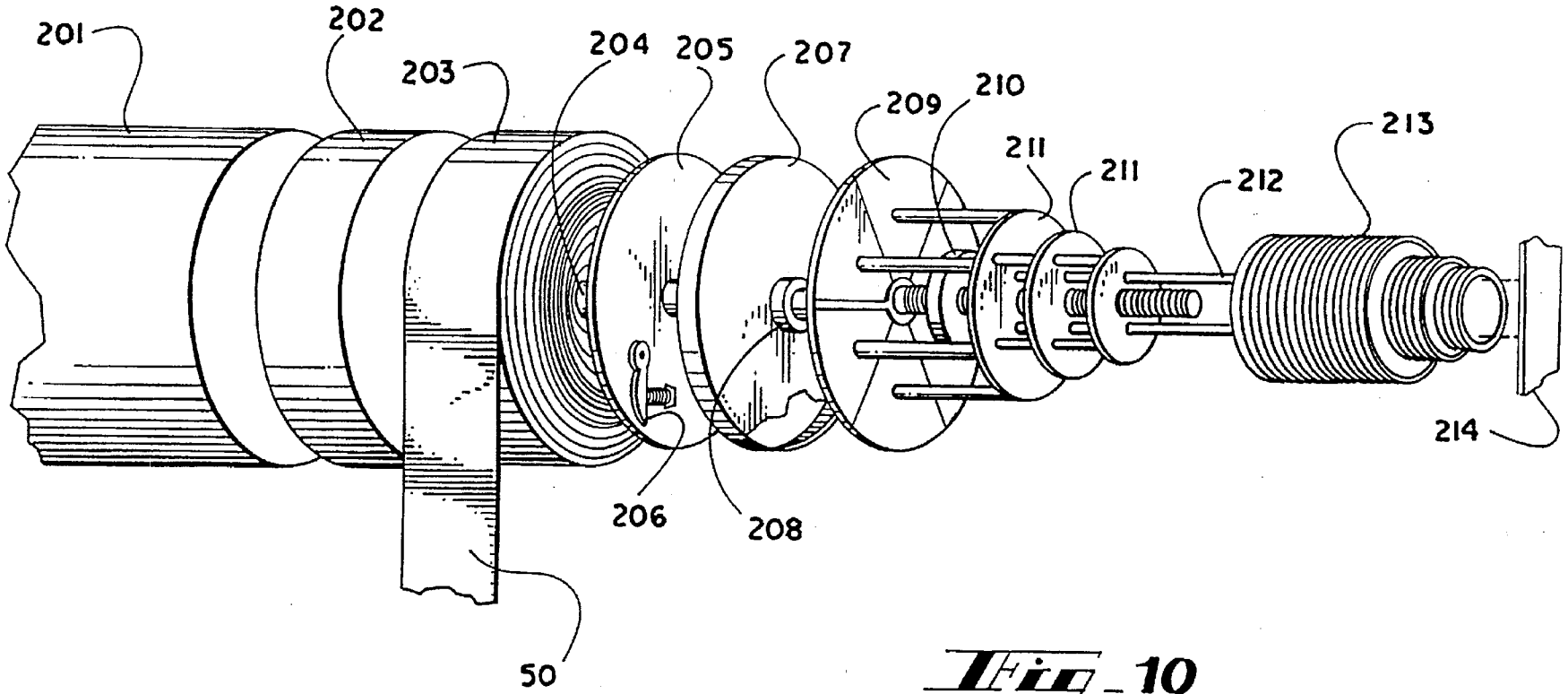
FIG. 10 is an exploded perspective view of an alternative embodiment of the internal mechanism of the support carrier of FIG. 1.

FIG. 10 discloses another manner of providing the retraction system for the support carrier 28 of the present invention. The embodiment shown includes a motor 201, a recoil mechanism 202, and a take-up reel 203 with tether line 50 extending therefrom, all being fixedly secured to a central axle 204. A rotor 205 is also fixed to this axle 204. A spring position lever 206 is attached to the rotor 205. A braking disc 207 encloses the rotor 205. A one-way bearing 208 attaches the braking disc 207 to the axle 204. Segmental braking pads 209 are located next to the braking disc 207. The forward end of the central axle 204 includes a threaded portion. An actuator disc 210 is threaded on this portion of the axle 204. Concentric brake supports 211 hold the brakes 209 in place and stabilizer bars 212 hold the brake supports 211 and actuator disc 210. A concentrically-positioned spring 213 provides pressure for the segmental brake pads 209. The end of the device shown in FIG. 9 is held in by an enclosure 214.

The device in FIG. 10 uses the recoil mechanism 202 and take-up reel 203 in a manner similar to the device shown in FIG. 9. These items help to maintain the tether line 50 in a taut position and help to keep the support carrier 28 directly above a patient. When excessive force is applied downward on the tether line 50, the rotor 205 spins and the increased centrifugal force causes the spring position lever 206 to be actuated and to engage the interior teeth on the braking disc 207. This spinning causes the actuator disc 210 to travel outward on the threaded portion of the axle as the patient belt is extended. As the actuator disc 210 is moving outward, the concentric brake 211 supports the sequential release of the pressure applied by the brake pads 209. In this manner, the speed in which the tether line 50 may be retracted out of the support carrier 28 is maintained at a minimum velocity.

It is to be understood that several other embodiments for supplying the retraction system of the present invention are possible. For example, a braking device disclosed in U.S. Pat. No. 5,147,265, would work to perform the needed results of the retraction system.

As can be understood from the above description, the present invention provides enhanced mobility and support for a patient. This system is intended for those patients who regularly are mobile. Some of these patients have no gait problems at all, but they are encumbered by fixed monitors and IV stands. These patients will benefit from the mobility afforded by the overhead design. IVs and monitors may follow the patient about the room with little or no effort provided by the patient.

The patient support system also benefits patients at high risk for falling, e.g., older adults or disoriented patients. Patients with good minds but weakened bodies may get up without prolonged wait for a nurse and without substantial risk. Many patients with diminished judgment or defective ambulation would no longer have to be tied to beds or require sitters.

Figure 11:
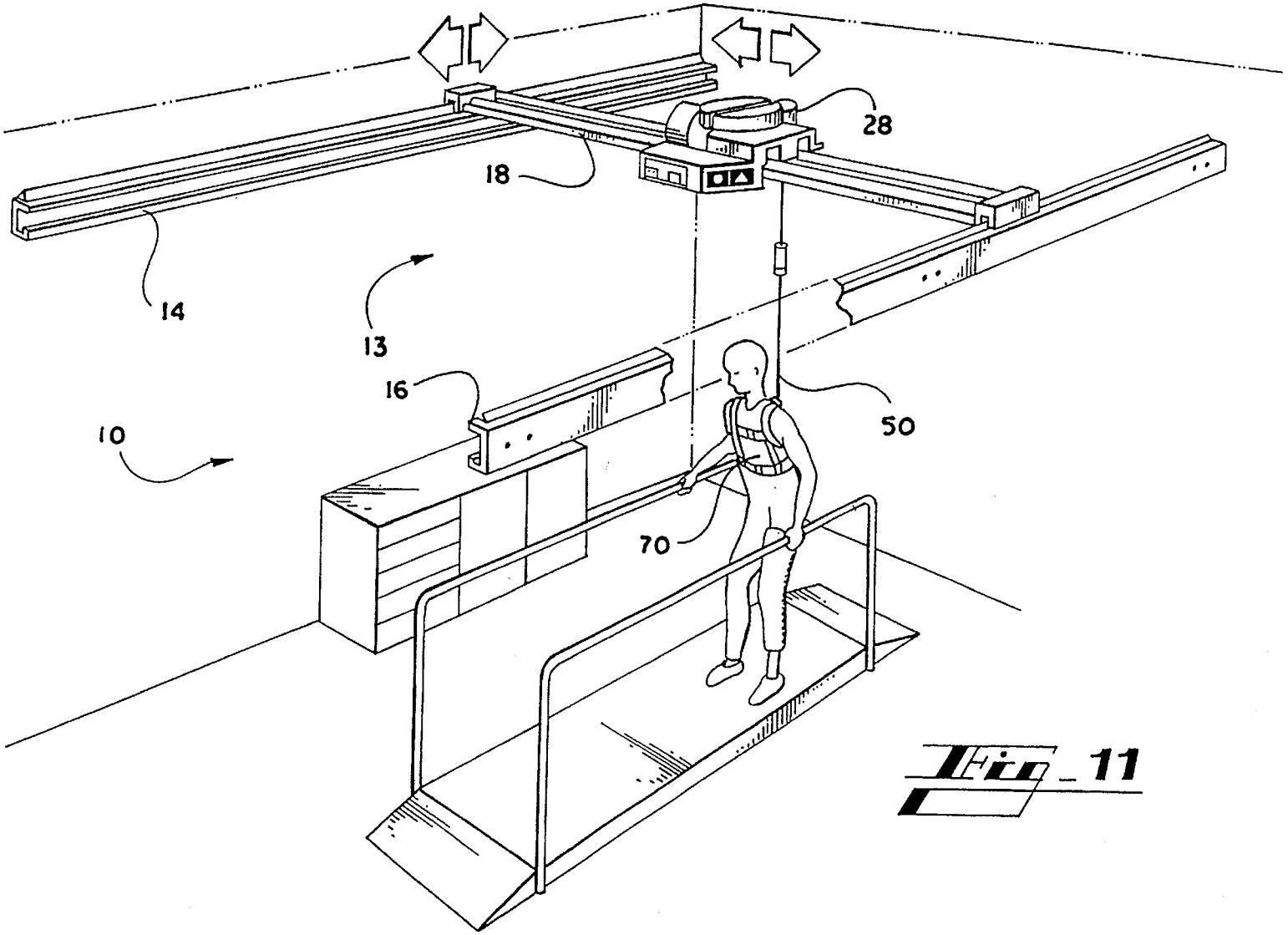
FIG. 11 is a perspective view of an alternative use for the ambulatory support system of FIG. 1 wherein the support system is used in a rehabilitation department.

The design allows the patient continued mobility so that the patient can move from a bed to a chair unassisted. Should a slip occur, the design protects the patient from a severe fall by the passive nature of the support system. Moreover, the system may be used to lend support to a patient in a rehabilitation department, as is shown in FIG. 11. In this manner, the patient may perform rehabilitation exercises without the need for support on both sides by hospital personnel.

While this system has been described in detail with a preferred embodiment in mind, modifications or alterations may be made without departing from the spirit and scope of the invention as defined in the following claims.

I claim:

1. A safety support device for providing ambulatory support to a patient, said device comprising:

a support garment wearable by the patient comprising a vest worn generally about the patient's thorax; and a support harness extending from said vest and positionable adjacent the back of the patient's head;

a tether line having a first end and an opposed free end attachable to said support garment;

a tether line retainer associated with said support harness adjacent the vertex of the patient's head when the patient is wearing said support garment;

a support carrier, said first end of said tether line disposed in supported engagement with said support carrier, and said support carrier capable of applying a support force to said support garment wherein, said tether line is disposed in restrained engagement with said support garment adjacent the vertex of the patient's head by said tether line retainer so that said tether line extends from said support garment substantially adjacent to the vertex of the patient's head when a support force is applied to said tether;

said support harness comprising a pillow support harness including a pillow enclosure adapted to receive a pillow therein;

said pillow support harness defining a base portion and an opposed attaching portion;

said base portion of said pillow support harness being attachable to said vest adjacent the superior borders of the patient's scapulae, bilaterally, and said tether line retainer being located at said opposed attaching portion; and said pillow enclosure being located between said base and said attaching portion, whereby said opposed attaching portion is disposed in restrained engagement with said tether line such that said tether line extends from said pillow support harness adjacent the vertex of the patient's head when a support force is applied to said tether.

2. The safety support device of claim 1 further including a pillow disposed within said pillow enclosure.

3. The safety support device of claim 1 wherein, said pillow enclosure is selectively configurable from a generally rectangular configuration to a generally triangular configuration wherein, when said pillow enclosure is disposed in said rectangular configuration said pillow enclosure is capable of receiving a pillow therein.

4. A safety support device for providing ambulatory support to a patient, said device comprising:

a support garment wearable by the patient comprising a vest worn generally about the patient's thorax; and a support harness extending from said vest and positionable adjacent the back of the patient's head;

a tether line having a first end and an opposed free end attachable to said support garment;

a tether line retainer associated with said support harness adjacent the vertex of the patient's head when the patient is wearing said support garment; and a support carrier, said first end of said tether line disposed in supported engagement with said support carrier, and said support carrier capable of applying a support force to said support garment wherein, said tether line is disposed in restrained engagement with said support garment adjacent the vertex of the patient's head by said tether line retainer so that said tether line extends from said support garment substantially adjacent to the vertex of the patient's head when a support force is applied to said tether;

a glide rail defining ends thereon and arranged to span between opposite sides of the room, said support carrier being operative to travel back and forth on said glide rail;

channels operative for securement in said room for supporting said glide rail mounted for travel along said channels such that said glide rail can move them along and such that said support carrier is capable of movement over a specified region of the room;

a retraction system associated with said support carrier and operative to apply a first upward force to said tether line responsive to a force applied vertically downward by said patient, said first force varying in relation to said downward force applied by said patient and the acceleration of said tether line downward responsive to said downward force such that said first force remains slightly less than said downward force and prevents said acceleration of said tether line downward from reaching a predetermined speed, whereby said retraction system works to decelerate a patient upon falling so that said patient is slowly lowered to the ground; and a traveling bridge for moving back and forth along said channels, said traveling bridge including an accessory dolly mounted for travel along said traveling bridge, said accessory dolly configured so as to receive a peripheral accessory whereby said peripheral accessory may be moved within an area underneath said overhead support system.

5. A safety support device for providing ambulatory support to a patient, said device comprising:

(a) a support garment wearable by the patient comprising:
a vest worn generally about the patient's thorax; and
a pillow support harness including a pillow enclosure adapted to receive a pillow therein, said pillow support harness defining a base portion and an opposed attaching portion, said base portion of said pillow support harness being attachable to said vest and said tether line retainer being located at said opposed attaching portion, and said pillow portion being located between said base portion and said attaching portion and being configured such that when a pillow is received in said pillow enclosure and the vest is on the patient, said pillow is adjacent the back of the patient's head;

(b) a tether line having a first end and an opposed free end attachable to said support garment;

(c) a tether line retainer associated with said support garment adjacent the vertex of the patient's head when the patient is wearing said support garment; and (d) a support carrier, said first end of said tether line disposed in supported engagement with said support carrier, and said support carrier capable of applying a support force to said support garment wherein, said opposed attaching portion is disposed in restrained engagement with said tether line such that said tether line extends from said pillow support harness adjacent the vertex of the patient's head when a support force is applied to said tether.

* * * * *